US010497240B2

(12) United States Patent
Alexis et al.

(10) Patent No.: US 10,497,240 B2
(45) Date of Patent: Dec. 3, 2019

(54) SYSTEMS AND METHODS FOR PROVIDING A PEDESTAL WITH COLLISION DAMAGE PROTECTION

(71) Applicants: Mark D. Alexis, Wellington, FL (US); Jose Hernandez, Boca Raton, FL (US)

(72) Inventors: Mark D. Alexis, Wellington, FL (US); Jose Hernandez, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 80 days.

(21) Appl. No.: 15/602,380

(22) Filed: May 23, 2017

(65) Prior Publication Data

US 2018/0341797 A1 Nov. 29, 2018

(51) Int. Cl.

| | |
|---|---|
| ***G08B 13/24*** | (2006.01) |
| ***H01Q 1/00*** | (2006.01) |
| ***H01Q 1/22*** | (2006.01) |
| ***H01Q 1/14*** | (2006.01) |
| ***H01Q 7/00*** | (2006.01) |
| ***H01Q 21/29*** | (2006.01) |

(52) U.S. Cl.

CPC ..... *G08B 13/2471* (2013.01); *G08B 13/2474* (2013.01); *H01Q 1/002* (2013.01); *H01Q 1/2216* (2013.01); *G08B 13/2462* (2013.01); *H01Q 1/14* (2013.01); *H01Q 7/00* (2013.01); *H01Q 21/29* (2013.01)

(58) Field of Classification Search

None

See application file for complete search history.

(56) References Cited

U.S. PATENT DOCUMENTS

| | | | | |
|---|---|---|---|---|
| 3,737,155 | A | 6/1973 | Karlan | |
| 5,349,881 | A * | 9/1994 | Olorenshaw | G05G 5/05 200/6 A |
| 5,952,631 | A * | 9/1999 | Miyaki | H03K 17/968 200/6 A |
| 6,331,838 | B1 * | 12/2001 | Scott | H01Q 1/085 343/715 |
| 7,443,361 | B2 * | 10/2008 | Haynes | H01Q 1/085 343/878 |
| 2005/0253768 | A1 * | 11/2005 | Bui Hung | H01C 25/00 343/790 |
| 2007/0109205 | A1 * | 5/2007 | Nelson | B63B 17/0081 343/709 |
| 2010/0277322 | A1 | 11/2010 | Eckert et al. | |
| 2011/0148636 | A1 | 6/2011 | Carlson | |

FOREIGN PATENT DOCUMENTS

DE 102004019701 A1 11/2005

* cited by examiner

*Primary Examiner* — Carlos Garcia

(74) *Attorney, Agent, or Firm* — Fox Rothschild LLP; Robert J. Sacco; Carol E. Thorstad-Forsyth

(57) ABSTRACT

A pedestal for an Electronic Article Surveillance ("EAS") system. The pedestal comprising: a frame; at least one antenna disposed in or coupled to the frame; and a rotatable member directly coupled to the frame so as to mechanically support the pedestal in a vertical position when in use and configured to allow the frame to transition from the vertical position to an angled position when a force is applied to the frame by an external object.

20 Claims, 7 Drawing Sheets

SYSTEMS AND METHODS FOR PROVIDING A PEDESTAL WITH COLLISION DAMAGE PROTECTION

BACKGROUND

Statement of the Technical Field

The present disclosure relates generally to pedestals. More particularly, the present disclosure relates to implementing systems and methods for providing a pedestal with collision damage protection.

Description of the Related Art

Anti-Theft pedestals or antennas are placed at the entrances to retail establishments as part of an overall system to deter theft and to track inventory. Typically, these pedestals are bolted to the floor near the store entrance to detect anti-theft tags attached to merchandise. The store entrance is often a high traffic area, and can result in collisions with shopping carts or customers resulting in damage to the pedestal or its mounting hardware.

SUMMARY

The present document concerns a pedestal for an Electronic Article Surveillance ("EAS") system. The pedestal comprises: a frame; at least one antenna disposed in or coupled to the frame; and a rotatable member directly coupled to the frame so as to mechanically support the pedestal in a vertical position when in use. The rotatable member is configured to allow the frame to transition from the vertical position to an angled position when a force is applied to the frame by an external object.

In some scenarios, the pedestal creates a surveillance zone in which active EAS security tags can be detected by the EAS system. Accordingly, the antenna is configured to transmit an electromagnetic exciter signal field or receive a signal generated by an EAS security tag in response to the electromagnetic exciter signal field.

In those or other scenarios, the rotatable member comprises a mechanical support structure, at least one detent engaging mechanism, and a chassis. The mechanical support structure has a distal end directly coupled to the frame. The detent engaging mechanism is directly coupled to a proximal end of the mechanical support structure, and comprises at least one protrusion extending out and away from a surface of the detent engaging mechanism. The the detent engaging mechanism is also rotatably coupled to the chassis. The chassis comprises at least one detent formed therein which catches the protrusion so as to prevent motion of the detent engaging mechanism until released via the application of the force to the frame.

In those or other scenarios, the detent engaging mechanism is rotatably coupled to the chassis via an elongate mechanical coupler (e.g., a bolt, screw, post or pin). A resilient member is disposed along a length the elongate mechanical coupler. The resilient member comprises a spring that is normally in an uncompressed state. A release threshold for the pedestal is set by adjusting a tension applied to the resilient member using at least the elongate mechanical coupler. The release threshold specifies an amount of force that needs to be applied to the frame by the external object so that the protrusion is released from the detent. The tension is adjusted by rotating a nut around an elongate threaded mechanical coupler.

In those or other scenarios, the pedestal further comprises a switch coupled to the rotatable member and adapted to disconnect the pedestal from an external power source when the force is applied to the frame by the external object. Additionally or alternatively, the pedestal comprises a proximity sensor configured to detect a position of the frame and communicate the detected position to a control system.

BRIEF DESCRIPTION OF THE DRAWINGS

Embodiments will be described with reference to the following drawing figures, in which like numerals represent like items throughout the figures.

DETAILED DESCRIPTION

Figure 1:
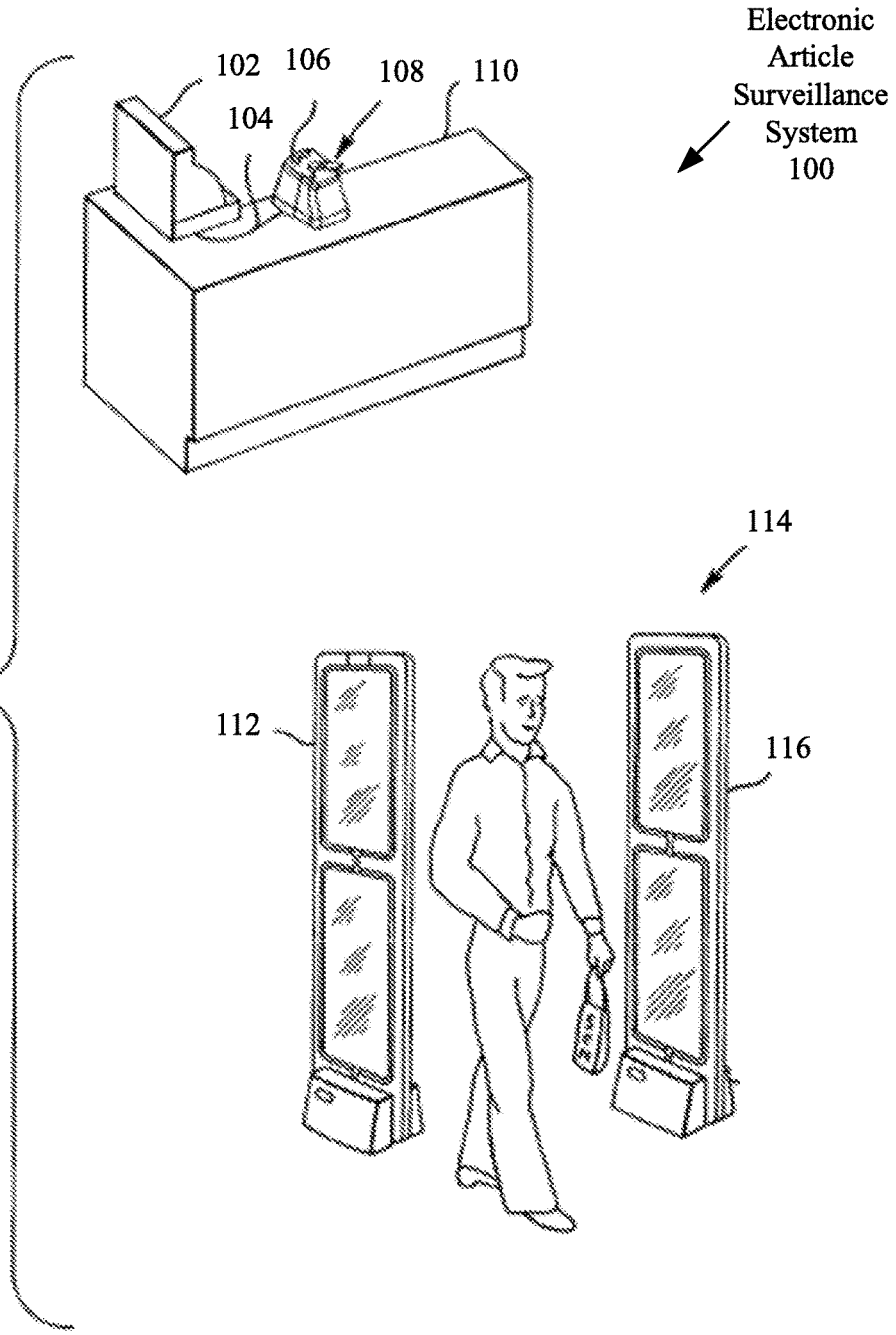
FIG. 1 is a schematic illustration of an exemplary architecture for an EAS system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution generally concerns system and methods for pedestals and/or antennas designed to be sufficiently robust to withstand expected collisions without permanent damage. In this regard, a mechanism is provided that allows the pedestal or antenna to "give way" in a collision for preventing damage thereto. Such a mechanism allows the use of (a) lower cost materials in the pedestal's or antenna's design and/or (b) more aesthetically appealing materials (such as thin transparent panels). The design also provides features that would prevent contact with hazardous voltages and/or sharp edges that can be exposed following a severe collision or pedestal break.

This mechanism provides desirable commercial advantages. For example, the pedestals or antennas implementing the mechanism can be restored to their normal positions and normal operations by store personnel after a collision. In effect, the cost and delay of a service call is eliminated. Furthermore, the ability to quickly restore the pedestals or antennas to their normal operations would prevent a store security outage.

Referring now to FIG. 1, there is provided a schematic illustration of an exemplary Electronic Article Surveillance ("EAS") system 100 that is useful for understanding the present solution. EAS systems are well known in the art, and therefore will not be described in detail herein. Still, it should be understood that the present solution will be described herein in relation to an acousto-magnetic (or magnetostrictive) EAS system. The present solution is not limited in this regard. The EAS system 100 may alternatively include a magnetic EAS system, an RF EAS system, a microwave EAS system or other type of EAS system. In all cases, the EAS system 100 generally prevents the unauthorized removal of articles from a retail store.

In this regard, EAS security tags 108 are securely coupled to articles (e.g., clothing, toys, and other merchandise) offered for sale by the retail store. At the exits of the retail store, detection equipment 114 sounds an alarm or otherwise alerts store employees when it senses an active EAS security tag 108 in proximity thereto. Such an alarm or alert provide notification to store employees of an attempt to remove an article from the retail store without proper authorization.

In some scenarios, the detection equipment 114 comprises antenna pedestals 112, 116. The antenna pedestals 112, 116 are configured to create a surveillance zone at the exit or checkout lane of the retail store by transmitting an EAS exciter signal. The EAS exciter signal causes an active EAS security tag 108 to produce a detectable response if an attempt is made to remove the article from the retail store. For example, the EAS security tag 108 can cause perturbations in the EAS exciter signal.

The antenna pedestals 112, 116 may also be configured to act as RFID readers. In these scenarios, the antenna pedestals 112, 116 transmit an RFID interrogation signal for purposes of obtaining RFID data from the active EAS security tag 108. The RFID data can include, but is not limited to, a unique identifier for the active EAS security tag 108. In other scenarios, these RFID functions are provided by devices separate and apart from the antenna pedestals.

The EAS security tag 108 can be deactivated and detached from the article using a detaching unit 106. Typically, the EAS security tag 108 is removed or detached from the articles by store employees when the corresponding article has been purchased or has been otherwise authorized for removal from the retail store. The detaching unit 106 is located at a checkout counter 110 of the retail store and communicatively coupled to a POS terminal 102 via a wired link 104. In general, the POS terminal 102 facilitates the purchase of articles from the retail store.

Detaching units and POS terminals are well known in the art, and therefore will not be described herein. The POS terminal 102 can include any known or to be known POS terminal with or without any modifications thereto. However, the detaching unit 106 includes any known or to be known detaching unit selected in accordance with a particular application.

In some cases, the detaching unit 106 is configured to operate as an RFID reader. As such, the detaching unit 106 may transmit an RFID interrogation signal for purposes of obtaining RFID data from an EAS security tag 108. Upon receipt of the unique identifier, the detaching unit 106 communicates the unique identifier to the POS terminal 102. At the POS terminal 102, a determination is made as to whether the unique identifier is a valid unique identifier for an EAS security tag of the retail store. If it is determined that the unique identifier is a valid unique identifier for an EAS security tag of the retail store, then the POS terminal 102 notifies the detaching unit 106 that the unique identifier has been validated, and therefore the EAS security tag 108 can be removed from the article.

Figure 2:
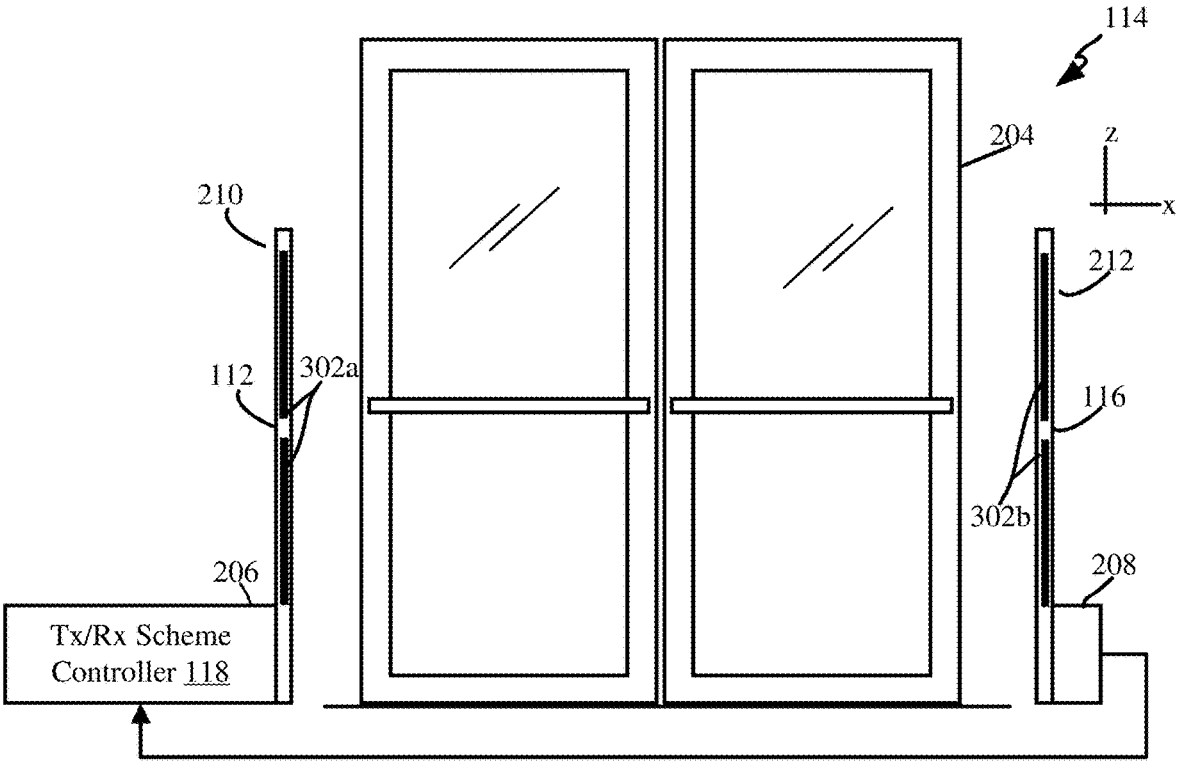
FIG. 2 is a side view of an EAS detection system.

The detection equipment 114 of FIG. 1 will now be described in more detail in relation to FIGS. 2 and 3. Notably, the detection equipment 114 is described here in terms of an AM EAS system. However, the EAS tag detection method described herein can also be used in other types of EAS systems, including systems that use RF type tags and RFID EAS systems.

The detection equipment 114 will be positioned at a location adjacent to an entry/exit 204 of a secured facility (e.g., a retail store). The detection equipment 114 uses specially designed EAS marker tags ("security tags") 108 which are applied to store merchandise or other items which are stored within a secured facility. The EAS security tags 108 can be deactivated or removed by authorized personnel at the secure facility. For example, in a retail environment, the EAS security tags 108 could be removed by store employees. When an active EAS security tag 108 is detected by the detection equipment 114 in an idealized representation of an EAS detection zone (or surveillance zone) 308 near the entry/exit, the detection equipment 114 will detect the presence of such security tag and will sound an alarm or generate some other suitable EAS response, as described above. Accordingly, the detection equipment 114 is arranged for detecting and preventing the unauthorized removal of articles or products from controlled areas.

As noted above in relation to FIG. 1, the detection equipment 114 includes a pair of pedestals 112, 116, which are located a known distance apart (e.g., at opposing sides of entry/exit 204). The pedestals 112, 116 are typically stabilized and supported by a base 206, 208. Notably, pedestal 112 is a master pedestal while pedestal 116 is a slave pedestal. Although one slave pedestal is shown in FIG. 2, the present solution is not limited in this regard. There can be any number of slave pedestals for a given application.

Base 206 of master pedestal 112 has a Tx/Rx scheme controller 118 disposed therein, or alternatively coupled thereto via a wired or wireless communications link. In the later configuration, the Tx/Rx scheme controller 118 may be located within a separate chassis at a location nearby to the master pedestal. For example, the Tx/Rx scheme controller 118 can be located in a ceiling just above or adjacent to the master pedestal 112. Base 206 is also communicatively coupled to base 208 via a wired or wireless communications link such that information specifying Tx/Rx schemes can be communicated from the master pedestal 112 to the slave pedestal 116 during operations thereof.

The Tx/Rx scheme controller 118 comprises hardware and/or software configured to: (a) implement a previously randomly selected Tx/Rx scheme that is unique to the master pedestal 112 (such as at a manufacture's facility or during an installation process); and/or (b) randomly select a Tx/Rx scheme from a plurality of Tx/Rx schemes to be employed by the master/slave pedestals 112, 116 during any given iteration of an EAS tag detection process. In the later scenario (b), the Tx/Rx scheme controller 118 randomly selects (1) the total number of timeslots or time windows in which an EAS exciter signal should be transmitted from a pedestal and (2) the particular timeslots or time windows in which the EAS exciter signal is to be transmitted from the pedestal.

The pedestals 112, 116 will each generally include one or more antennas that are suitable for aiding in the detection of EAS security tags, as described herein. In some scenarios, the master pedestal includes an antenna suitable for transmitting or producing an electromagnetic exciter signal field in the detection zone. The EAS transmitter is operated in a time multiplex manner using a plurality of N timestamps or windows, where N is an integer (e.g., 10). The slave pedestal includes an antenna suitable for receiving response signals generated by security tags in the detection zone. The antennas provided in the pedestals can be conventional conductive wire coil or loop designs as are commonly used in AM type EAS pedestals.

In other scenarios, the master pedestal 112 includes at least one antenna 302*a* disposed in a housing or frame 210 thereof. The antenna 302*a* is suitable for transmitting or producing an electromagnetic exciter signal field and receiving response signals generated by EAS security tags 108 in the detection zone 308. In some scenarios, the same antenna can be used for both receive and transmit functions. Similarly, the slave pedestal 116 can include at least one antenna 302*b* disposed in or coupled to a housing or fame 212 thereof. The antenna 302*b* is suitable for transmitting or producing an electromagnetic exciter signal field and receiving response signals generated by security tags in the detection zone 308. The antennas provided in the pedestals 112, 116 can be conventional conductive wire coil or loop designs as are commonly used in AM type EAS pedestals. These antennas will sometimes be referred to herein as exciter coils. In some scenarios, a single antenna can be used in each pedestal. The single antenna is selectively coupled to the EAS receiver. The EAS transmitter is operated in a time multiplexed manner as described herein. However, it can be advantageous to include two antennas (or exciter coils) in each pedestal as shown in FIG. 2, with an upper antenna positioned above a lower antenna.

As noted above, the detection equipment 114 comprises an AM type EAS detection system. As such, each antenna is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in an EAS security tag within a detection zone 308. As a result of the stimulus signal, the EAS security tag 108 will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone 308. As noted above, the same antenna contained in a pedestal 112, 116 can serve as both the transmit antenna and the receive antenna. Accordingly, the antennas in each of the pedestals 112, 116 can be used in several different modes to detect a security tag exciter signal.

Figure 4:
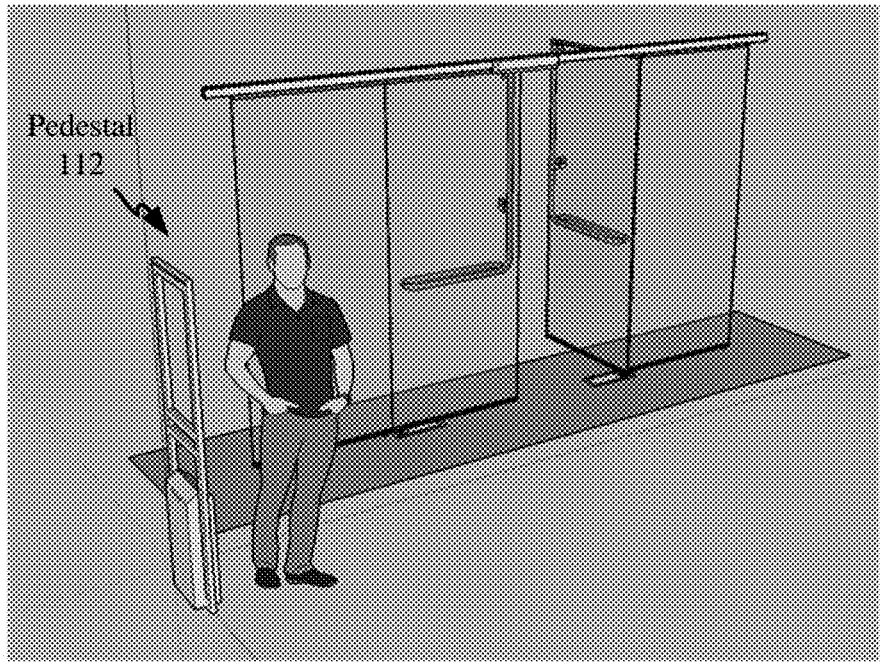
FIG. 4 provides an illustration showing an antenna pedestal in a vertical position.
Figure 5:
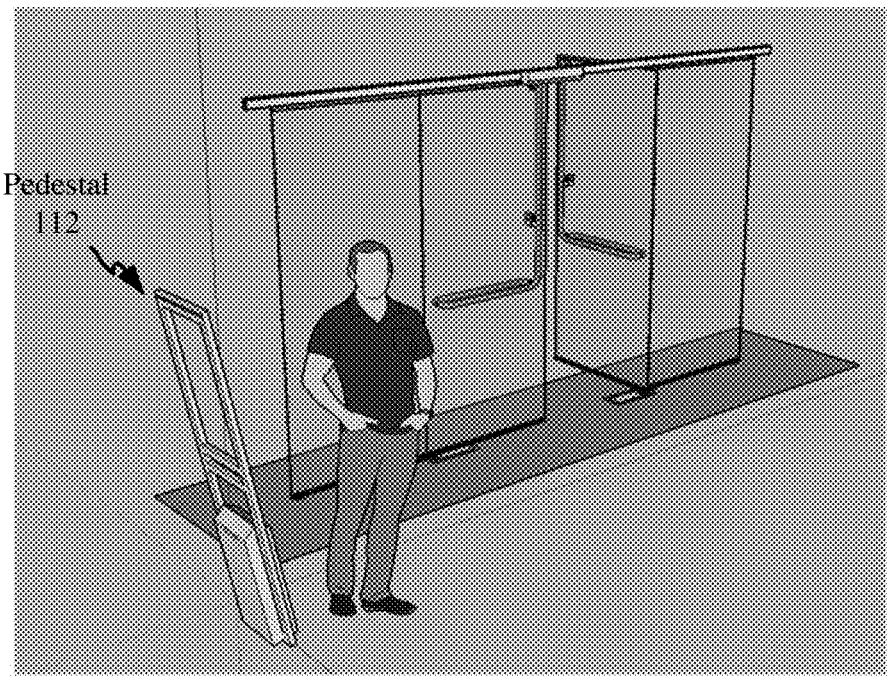
FIG. 5 provides an illustration showing an antenna pedestal in an angled position.

Notably, the pedestals 112, 116 are designed to be sufficiently robust to withstand expected collisions without permanent damage. In this regard, a mechanism is provided in each pedestal 112, 116 that allows the pedestals to "give way" in a collision for preventing damage thereto. This is illustrated in FIGS. 4-5. In FIG. 4, the pedestal 112 in its normal position. In FIG. 5, the pedestal 112 is in its angled position after a collision. In this angled position, the antenna 302*a* is temporarily disabled but not damaged as a result of the collision.

An exemplary architecture for the mechanism will now be provided in relation to FIGS. 6-9. A side view of the mechanism 600 coupled to the pedestal 112 is provided in FIG. 6. A front view of the mechanism 600 in its normal vertical position is provided in FIG. 7 and in its angled position in FIG. 8. An exploded view of the mechanism 600 is provided in FIG. 9. Notably, pedestal 116 is the same as or substantially similar to pedestal 112. As such, the following discussion of pedestal 112 and mechanism 600 is sufficient for understanding pedestal 116 and its corresponding mechanism.

The mechanism 600 is formed of one or more materials selected for a particular application. Such materials can include, but are not limited to, plastics, metals and/or nylon. All of the components of the mechanism 600 can be formed of a single material (e.g., plastic or metal). Alternatively, some of the components are formed of a first material (e.g., plastic) while other components are formed of a second different material (e.g., metal).

Figure 6:
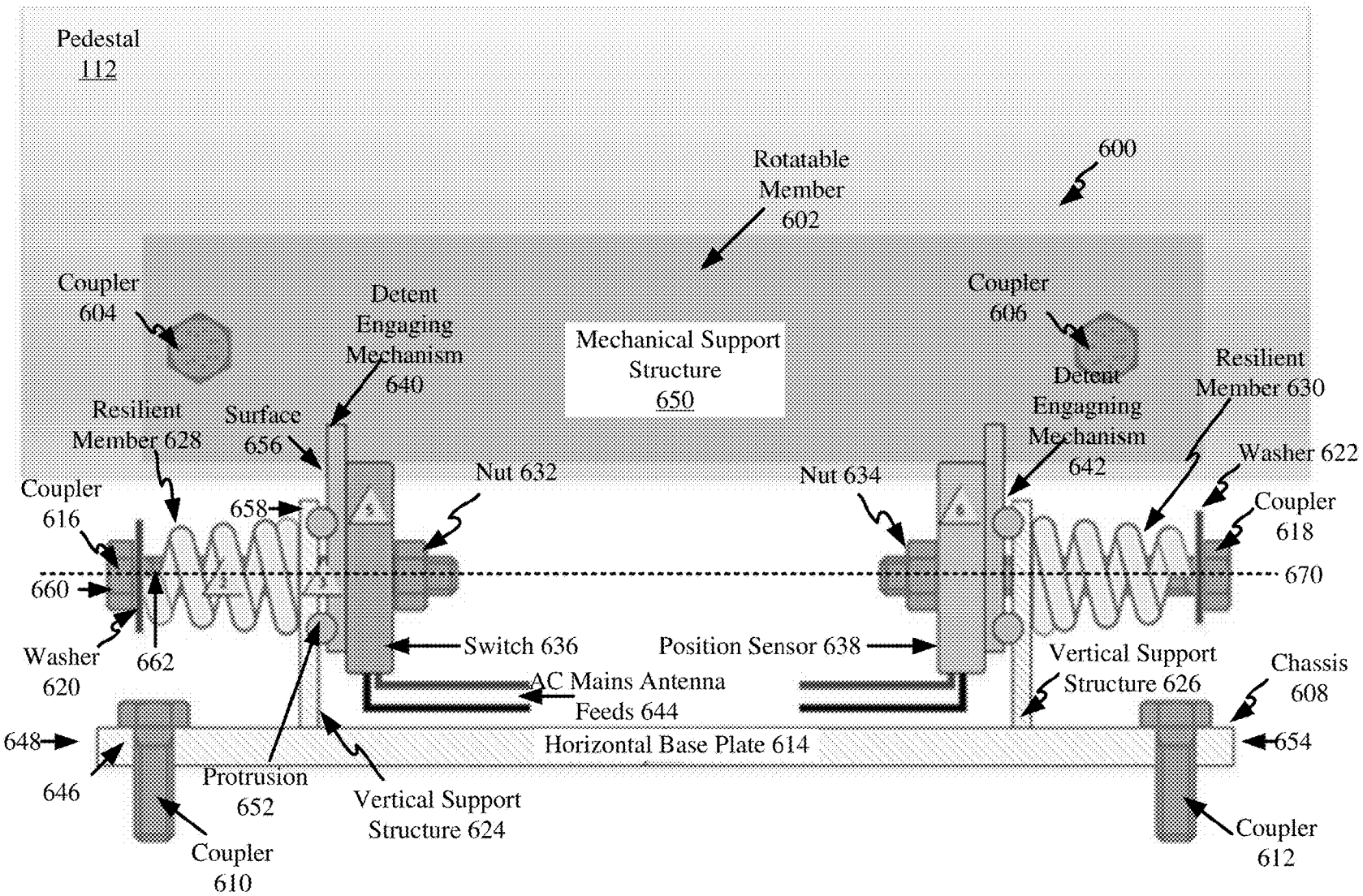
FIG. 6 provides a side view of a mechanism coupled to a pedestal's frame.

As shown in FIG. 6, the mechanism 600 comprises a rotatable member 602 coupled to the pedestal 112 and a chassis 608. The chassis 608 is configured to structurally support the rotatable member 602. In this regard, the chassis 608 comprises a horizontal base plate 614 with at least two (2) apertures 646 formed therethrough at opposing ends 648, 654 thereof. The apertures 646 provide a means to securely coupled the mechanism 600 to the floor or other base structure. Accordingly, the apertures 646 are sized and shaped to receive couplers 610, 612. Coupler 610, 612 can include, but are not limited to, threaded bolts, screws, posts or pins.

The chassis 608 also comprises two (2) vertical support structures 624, 626 extending up and away from the horizontal base plate 614. The vertical support structures 624, 626 are disposed at opposing ends 648, 654 of the horizontal base plate 614, and are respectively placed the same distance from the ends 648, 654. The vertical support structures 624, 626 are coupled to the horizontal base plate 614 via a coupling means (e.g., adhesive or weld). Alternatively, the vertical support structures 624, 626 are integrally formed with the horizontal base plate 614 (e.g., during a molding process). Each vertical support structure 624, 626 has an aperture (not visible in FIGS. 6-8) formed therethrough that is sized and shaped to receive at least a portion 616, 618 of the rotatable member 602. In this way, the vertical support structure 624, 626 structurally supports the rotatable member 602 in a manner that allows rotatable portions thereof to rotate (e.g., when an object collides or impacts the pedestal 112) without coming in contact with the horizontal base plate or other base structure (e.g., the floor).

The rotatable member 602 allows for the rotational movement of the pedestal 112 in a direction away from a colliding object (e.g., a person or shopping cart). The rotatable member 602 comprises two (2) detent engaging mechanisms 640, 642 coupled to a mechanical support structure 650 that are rotatable about an axis 670. The detent engaging mechanisms 640, 642 are respectively rotatably coupled to the vertical support structures 624, 626 of the chassis 608. Each detent engaging mechanism 640, 642 comprises a plurality of protrusions 652 extending out and away from a surface 656 thereof. The protrusions 652 are designed to facilitate the sliding engagement thereof with the respective vertical support structure 624, 626. In some scenarios, the protrusions have round shapes. The vertical support structure 624, 626 has a plurality of circular detents 658 (e.g., dimples) formed therein which catch the round protrusions 652 (e.g., ball bearings) so as to prevent motion of the detent engaging mechanism 640, 642 until released via the application of force thereto (e.g., resulting from the collision or impact of an object with the pedestal). The present solution is not limited to the particulars of these scenarios. For example, the protrusions 652 may alternatively comprises chamfered edges that slide against corresponding chamfered edges of the vertical support structure's detents 658. Other protrusion-detent designs are contemplated here.

The mechanical support structure 650 is securely and fixedly coupled to the detent engaging mechanisms 640, 642 and the pedestal 112. In some scenarios, the mechanical support structure 650 is coupled to the detent engaging mechanisms 640, 642 via an adhesive or weld. In other scenarios, the mechanical support structure 650 is integrally formed with the detent engaging mechanisms 640, 642. The mechanical support structure 650 is securely and fixedly coupled to the pedestal 112 via couplers 604 and 606. Couplers 604 and 606 can include, but are not limited to, threaded bolts, screws, pins and/or posts.

Figure 8:
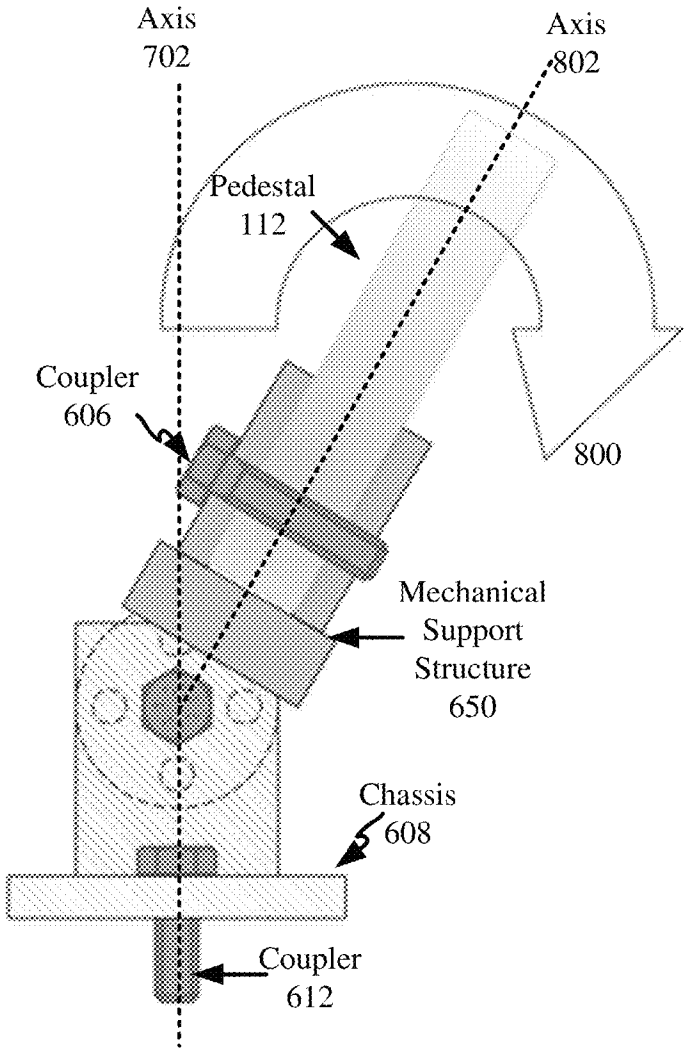
FIG. 8 is a front view showing an antenna pedestal in an angled position.
Figure 7:
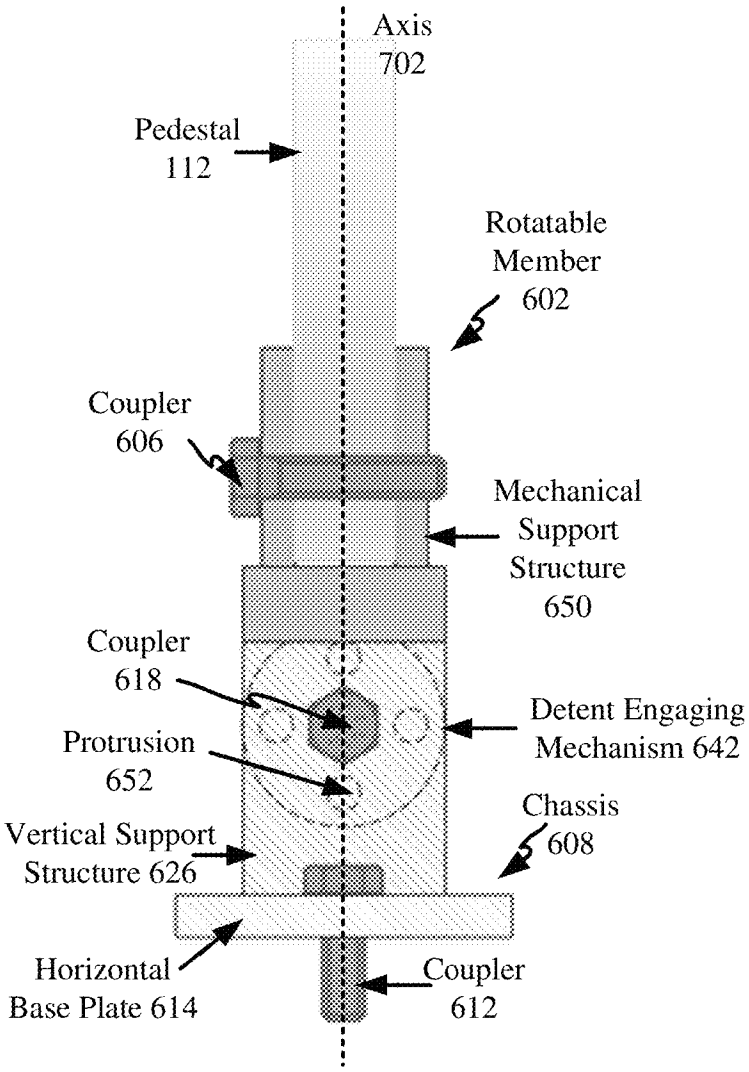
FIG. 7 is a front view showing an antenna pedestal in a vertical position.
Figure 9:
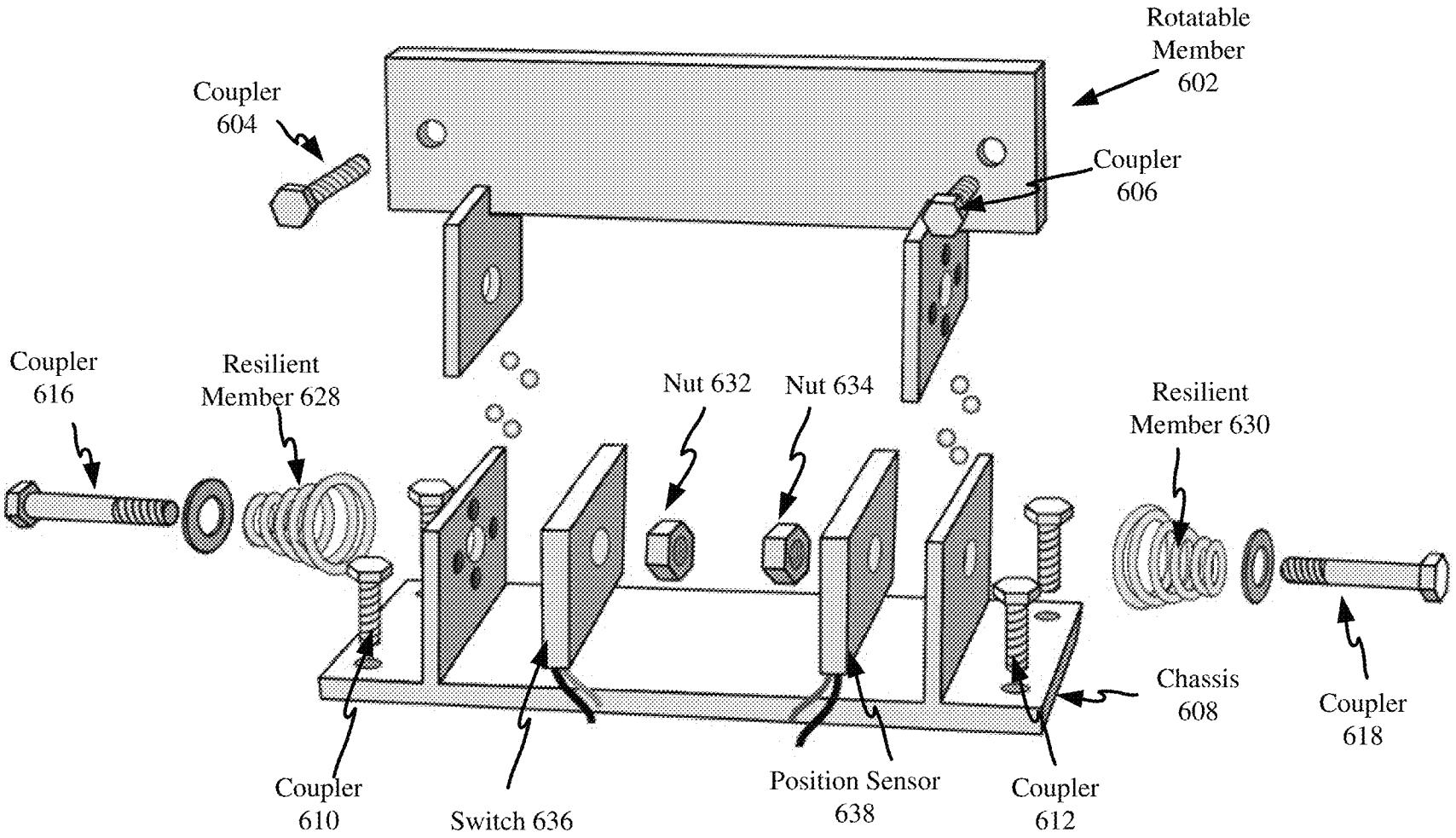
FIG. 9 provides an exploded view of the mechanism shown in FIG. 6.

As shown in FIGS. 7-8, the mechanical support structure 650 has a generally U-shape. The present solution is not limited in this regard. The mechanical support structure 650 can have any shape and/or form suitable for a particular application. For example, the mechanical support structure 650 may alternatively have a generally L-shape or a planar shape (i.e., comprise a single planar plate or two spaced apart parallel planar plates with or without a peripheral ledge).

The detent engaging mechanisms 640, 642 and mechanical support structure 650 are designed to hold the pedestal 112 in its normal vertical position (shown in FIG. 4 and FIG. 7) and allow the pedestal 112 to transition to its angled position (shown in FIG. 5 and FIG. 8) when sufficient force is applied thereto (as is the case of an accidental collision therewith by a person or shopping cart). In the vertical position, a center axis 802 of the pedestal is vertically aligned with a center axis 702 of the chassis 608, as shown in FIG. 7. In the angled position, the center axis 802 of the pedestal is angled relative to the center axis 702 of the chassis 608, as shown in FIG. 8. When sufficient force is applied to the pedestal 112, the pedestal 112 "gives way" or rotates in a direction shown by arrow 800 away from the colliding object thereby avoiding breakage or permanent damage thereto.

A release threshold of each detent engaging mechanism 640, 642 can be adjusted via the tension applied to the resilient members 628, 630 via the couplers 616, 618, washers 620, 622 and/or nuts 632, 634. The release threshold specifies an amount of force that needs to be applied to the pedestal's frame by the external object so that the protrusion(s) is(are) released from the detent(s). Each resilient member 628, 630 comprises a spring that is (a) normally in an uncompressed state and (b) disposed along an elongate length of the respective coupler 616, 618 (e.g., an elongate bolt, screw or pin). The coupler 616, 618 comprises a head 660 and a main body 662. The head 660 has a greater width or diameter than that of the main body 662. As such, in some scenarios, the head 660 provides a means for retaining the resilient member 628, 630 on the main body 662 during operation of the mechanism 600. Alternatively, a washer 620, 622 is provided for retaining the resilient member 628, 630 on the main body 662. In both scenarios, the vertical support structure 624, 626 also facilitates the retention of the resilient member 628, 630 on the main body 662. The coupler 616, 618 has threads formed thereon so that rotation of a nut 632, 634 can adjust the amount of the main body's length along which the resilient member 628, 630 extends.

The release threshold specifies the amount of force that needs to be applied to the pedestal 112 so as to release the protrusions 652 from the detents 658. If a relatively low threshold value is desired, then the nut 632, 634 and coupler 616, 618 (e.g., a threaded bolt or screw) are adjusted for reducing the amount of compression of the resilient member 628, 630 (e.g., a spring). If a relatively high threshold value is desired, then the nut 632, 634 and coupler 616, 618 (e.g., a threaded bolt or screw) are adjusted for increasing the amount of compression of the resilient member 628, 630 (e.g., a spring). In this case, each resilient member 628, 630 is disposed along a length of the respective coupler 616, 618 and is normally in an uncompressed state.

The mechanism 600 also comprises a switch 636 coupled to Alternating Current ("AC") mains antenna feeds 644 and the detent engaging mechanism 640. The switch 636 disconnects the pedestal 112 from the AC mains antenna feeds 644 when an object collides or impacts the pedestal 112. In this regard, the switch 636 is normally closed, and opens when the pedestal 112 transitions into its angled position in response to the object's collision or impact therewith. The switch 636 prevents any possible exposure to hazardous AC mains voltages subsequent to the collision or impact. Switches are well known in the art, and therefore will not be described herein. Any known or to be known switch (e.g., an electrical switch) can be used herein without limitation. If needed, the switch can be supplied power from an external power source (e.g., a battery or energy harvesting circuit of the system controller 118).

The mechanism 600 further comprises a position sensor 638 coupled to the detent engaging mechanism 642. The position sensor 638 is configured to provide a signal to the system controller 118 indicating the current position of the pedestal 112. This signal can be sent periodically at predetermined times, only when the pedestal 112 is transitioned out of its normal vertical position, or only when the pedestal 112 enters into its angled position. In response to the signal, the system controller 118 performs operations to (a) disable power to the pedestal 112, prevent signals from being sent to/from the pedestal 112, and/or notify service personnel. Position sensors are well known in the art, and therefore will not be described here. Any known or to be known position sensor can be used herein without limitation. In some scenarios, the position sensor includes an on/off switch or a sensor that provides an actual position angle. The position sensor can be supplied power from an external power source (e.g., a battery or energy harvesting circuit of the system controller 118) if needed.

The mechanism 600 is not limited to the architecture shown in FIGS. 6-9. For example, in some scenarios, the mechanism 600 may be provided without the switch 636 and/or position sensor 638.

Figure 10:
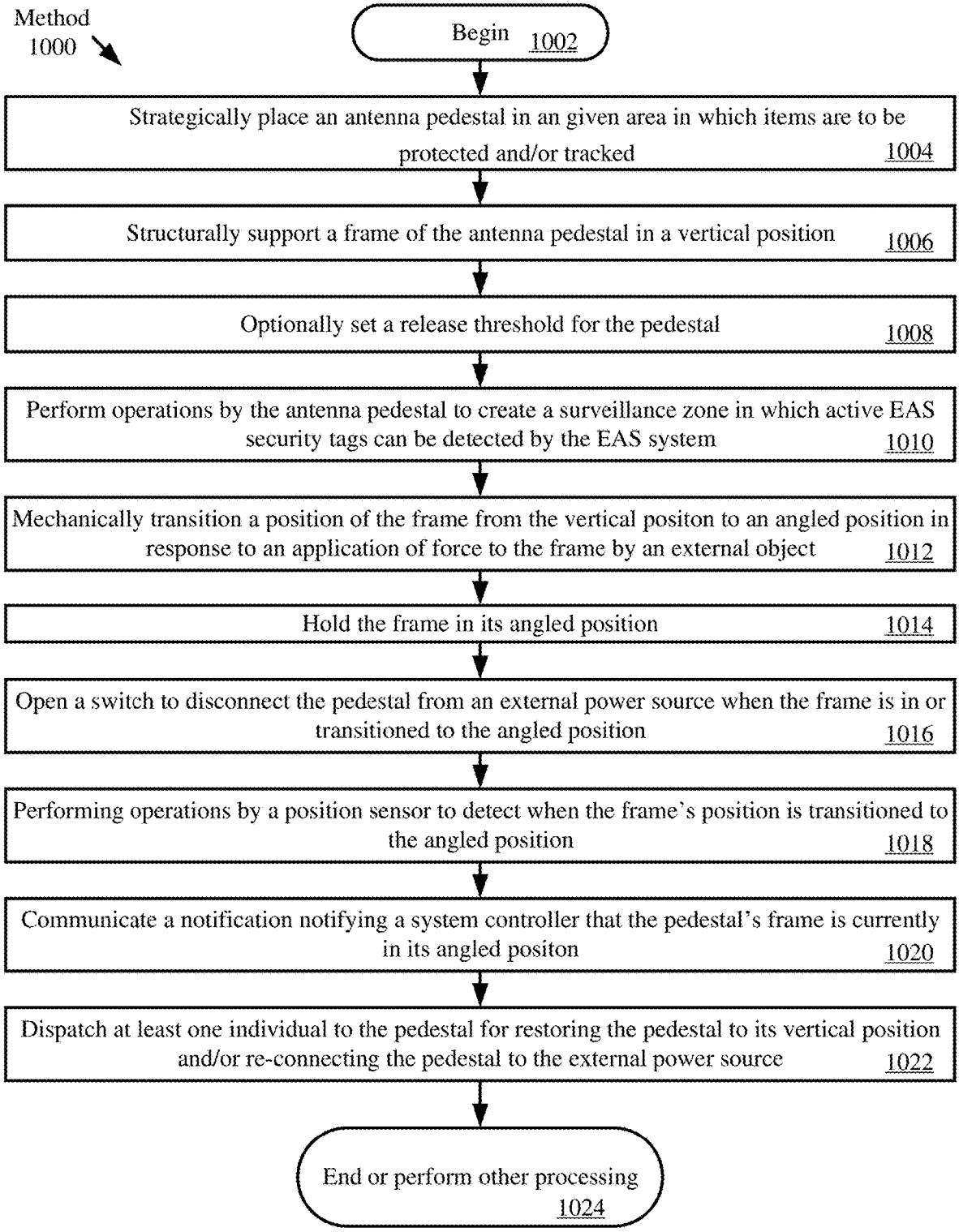
FIG. 10 provides a flow diagram of an exemplary method for operating an antenna pedestal of an EAS system.

Referring now to FIG. 10, there is provided a flow diagram of an exemplary method 1000 for operating a pedestal (e.g., pedestal 112 or 116 of FIG. 1) for an Electronic Article Surveillance ("EAS") system (e.g., EAS system 100 of FIG. 1). Method 1000 begins with 1002 and continues with 1004 where an antenna pedestal (e.g., antenna pedestal 112 or 116 of FIG. 1) is strategically placed in a given area (e.g., at the exit or checkout lane of the retail store) in which items (e.g., retail store merchandise) are to be protected (e.g., from theft) or tracked (e.g., for inventorying purposes). Next in 1006, a frame (e.g., frame 210 or 212 of FIG. 2) of the antenna pedestal is structurally supported in a vertical position. In some scenarios, the frame is maintained in the vertical position while the pedestal is in use at least partially by a chassis (e.g., chassis 608 of FIG. 6). The chassis has a detent (e.g., detent 658 of FIG. 6) formed therein catching a protrusion (e.g., protrusion 652 of FIG. 6) of a detent engaging mechanism (e.g., detent engaging mechanism 640 or 642 of FIG. 6) coupled to the frame.

A release threshold of the pedestal can be optionally set in 1008. The release threshold is set by adjusting a tension applied to a resilient member (e.g., resilient member 628 or 630 of FIG. 6) disposed along a length of an elongate mechanical coupler (e.g., coupler 616 or 618 of FIG. 6) rotatably coupling the detent engaging member to the chassis. The release threshold specifies an amount of force that needs to be applied to the frame by the external object (e.g., a person or shopping cart) so that the protrusion of the detent engaging member is released from the detent of the chassis.

Figure 3:
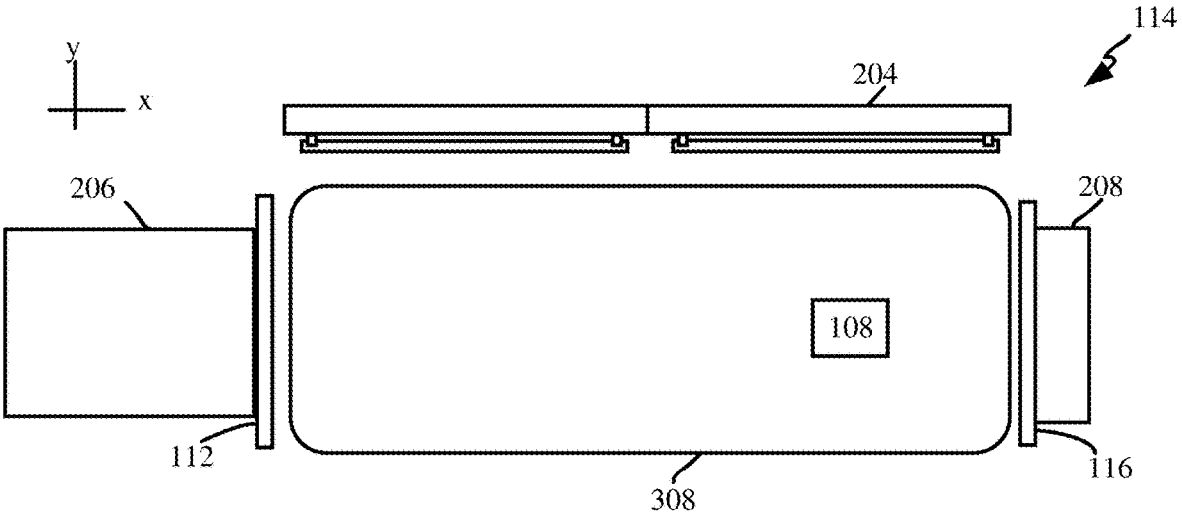
FIG. 3 is a top view of the EAS detection system in FIG. 2, which is useful for understanding an EAS detection zone thereof.

In 1010, the antenna pedestal performs operations to create a surveillance zone (e.g., EAS detection zone (or surveillance zone) 308 of FIG. 3) in which active EAS security tags (e.g., EAS security tag 108 of FIG. 1) can be detected by the EAS system. Methods for creating surveillance zones are well known in the art, and therefore will not be described in detail herein. Any known or to be known method for creating a surveillance zone can be used herein without limitation. For example, in some scenarios, the antenna is configured to transmit an electromagnetic exciter signal field and/or receive a signal generated by an EAS security tag in response to the electromagnetic exciter signal field.

Thereafter in 1012, a force is applied to the antenna pedestal's frame by an external object (e.g., a person or shopping cart). Consequently, the frame's position is mechanically transitioned from its vertical position (e.g., the vertical position shown in FIGS. 1-4 and 7) to its angled position (e.g., the angled position shown in FIGS. 5 and 8). In some scenarios, the frame's position is mechanically transitioned by releasing the protrusion from the detent. The frame's position is held in the angled position by capturing the protrusion in another detent of the chassis, as shown by 1014.

In 1016, a switch (e.g., switch 636 of FIG. 6) is opened whereby the pedestal is disconnected from an external power source when the frame is in or transitioned to the angled position. In 1018, a position sensor (e.g., position sensor 638 of FIG. 6) performs operations to detect when the frame's position is transitioned to the angled position. Upon such detection, a system controller (e.g., controller 118 of FIG. 2) is notified that the pedestal's frame is currently in its angled position. In response to this notification, at least one individual (e.g., store personnel) is dispatched to the antenna pedestal for restoring the frame to its vertical position and/or re-connecting the antenna pedestal to the external power source (e.g., an AC mains). Subsequently, 1024 is performed where method 1000 ends or other processing is performed (e.g., return to 1004, 1006 or 1010).

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A pedestal for an Electronic Article Surveillance ("EAS") system, comprising:

a frame;

at least one antenna disposed in or coupled to the frame; and a rotatable member directly coupled to the frame so as to mechanically support the pedestal in a vertical position when in use and configured to allow the frame to transition from the vertical positon to an angled position when a force is applied to the frame by an external object by causing the frame to rotate about a first center axis of a resilient member;

wherein the first center axis of the resilient member is perpendicular to a second center axis of the frame when the frame is in the vertical position; and wherein the pedestal is configured to facilitate detections of active tags by the EAS system.

2. A pedestal for an Electronic Article Surveillance ("EAS") system, comprising:

a frame;

at least one antenna disposed in or coupled to the frame; and a rotatable member directly coupled to the frame so as to mechanically support the pedestal in a vertical position when in use and configured to allow the frame to transition from the vertical positon to an angled position when a force is applied to the frame by an external object by causing the frame to rotate about a first center axis of a resilient member that is perpendicular to a second center axis of the frame when in the vertical position;

wherein the antenna is configured to transmit an electromagnetic exciter signal field or receive a signal generated by an EAS security tag in response to the electromagnetic exciter signal field.

3. A pedestal for an Electronic Article Surveillance ("EAS") system, comprising:

a frame;

at least one antenna disposed in or coupled to the frame; and a rotatable member directly coupled to the frame so as to mechanically support the pedestal in a vertical position when in use and configured to allow the frame to transition from the vertical positon to an angled position when a force is applied to the frame by an external object by causing the frame to rotate about a first center axis of a resilient member that is perpendicular to a second center axis of the frame when in the vertical position;

wherein the pedestal creates a surveillance zone in which active EAS security tags can be detected by the EAS system.

4. A pedestal for an Electronic Article Surveillance ("EAS") system, comprising:

a frame;

at least one antenna disposed in or coupled to the frame; and a rotatable member directly coupled to the frame so as to mechanically support the pedestal in a vertical position when in use and configured to allow the frame to transition from the vertical positon to an angled position when a force is applied to the frame by an external object;

wherein the rotatable member comprises:

a mechanical support structure having a distal end directly coupled to the frame;

at least one detent engaging mechanism directly coupled to a proximal end of the mechanical support structure and comprising at least one protrusion extending out and away from a surface of the detent engaging mechanism; and a chassis to which the detent engaging mechanism is rotatably coupled, the chassis comprising at least one detent formed therein which catches the protrusion so as to prevent motion of the detent engaging mechanism until released via the application of the force to the frame.

5. The pedestal according to claim 4, wherein the detent engaging mechanism is rotatably coupled to the chassis via an elongate mechanical coupler.

6. The pedestal according to claim 5, wherein a resilient member is disposed along a length the elongate mechanical coupler.

7. The pedestal according to claim 6, wherein the resilient member comprises a spring that is normally in an uncompressed state.

8. The pedestal according to claim 6, wherein a release threshold for the pedestal is set by adjusting a tension applied to the resilient member using at least the elongate mechanical coupler.

9. The pedestal according to claim 8, wherein the release threshold specifies an amount of force that needs to be applied to the frame by the external object so that the protrusion is released from the detent.

10. The pedestal according to claim 8, wherein the tension is adjusted by rotating a nut around an elongate threaded mechanical coupler.

11. A pedestal for an Electronic Article Surveillance ("EAS") system, comprising:

a frame;

at least one antenna disposed in or coupled to the frame; and a rotatable member directly coupled to the frame so as to mechanically support the pedestal in a vertical position when in use and configured to allow the frame to transition from the vertical positon to an angled position when a force is applied to the frame by an external object;

wherein the pedestal further comprises a switch coupled to the rotatable member and adapted to disconnect the pedestal from an external power source when the force is applied to the frame by the external object.

12. A pedestal for an Electronic Article Surveillance ("EAS") system, comprising:

a frame;

at least one antenna disposed in or coupled to the frame; and a rotatable member directly coupled to the frame so as to mechanically support the pedestal in a vertical position when in use and configured to allow the frame to transition from the vertical positon to an angled position when a force is applied to the frame by an external object;

wherein the pedestal further comprises a proximity sensor configured to detect a position of the frame and communicate the detected positon to a control system.

13. A method for operating an antenna pedestal of an Electronic Article Surveillance ("EAS") system, comprising:

structurally supporting a frame of the antenna pedestal in a vertical position;

performing operations by the antenna pedestal to create a surveillance zone in which active EAS security tags can be detected by the EAS system; and mechanically transitioning a position of the frame from the vertical positon to an angled position in response to an application of force to the frame by an external object by causing the frame to rotate about a first center axis of a resilient member that is perpendicular to a second center axis of the frame when in the vertical position.

14. The method according to claim 13, wherein the frame is maintained in the vertical position while the pedestal is in use by a chassis having a detent formed therein catching a protrusion of a detent engaging mechanism coupled to the frame.

15. The method according to claim 14, wherein the frame's position is mechanically transitioned by releasing the protrusion from the detent.

16. The method according to claim 15, further comprising setting a release threshold for the pedestal by adjusting a tension applied to a resilient member disposed along a length of an elongate mechanical coupler rotatably coupling the detent engaging member to a chassis.

17. The method according to claim 16, wherein the release threshold specifies an amount of force that needs to be applied to the frame by the external object so that the protrusion of the detent engaging member is released from the detent of the chassis.

18. A method for operating an antenna pedestal of an Electronic Article Surveillance ("EAS") system, comprising:

structurally supporting a frame of the antenna pedestal in a vertical position;

performing operations by the antenna pedestal to create a surveillance zone in which active EAS security tags can be detected by the EAS system; and mechanically transitioning a position of the frame from the vertical positon to an angled position in response to an application of force to the frame by an external object;

opening a switch to disconnect the pedestal from an external power source when the frame is in or transitioned to the angled position.

19. A method for operating an antenna pedestal of an Electronic Article Surveillance ("EAS") system, comprising:

structurally supporting a frame of the antenna pedestal in a vertical position;

performing operations by the antenna pedestal to create a surveillance zone in which active EAS security tags can be detected by the EAS system; and mechanically transitioning a position of the frame from the vertical positon to an angled position in response to an application of force to the frame by an external object;

performing operations by a position sensor to detect when the frame's position is transitioned to the angled position.

20. The method according to claim 19, further comprising communicating the frame's positon detected by the position sensor to a control system of the pedestal.

* * * * *